US006529699B2

(12) United States Patent
Ishii et al.

(10) Patent No.: US 6,529,699 B2
(45) Date of Patent: Mar. 4, 2003

(54) IMAGE FORMING APPARATUS AND PROCESS CARTRIDGE DETACHABLY ATTACHABLE TO IMAGE FORMING APPARATUS COMPRISING AN IMAGE BEARING BODY, AND A DEVELOPER CARRYING BODY

(75) Inventors: Yasuyuki Ishii, Mishima (JP); Tetsuya Kobayashi, Numazu (JP); Tsuyoshi Nakagawa, Tokyo (JP); Shinji Uehara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/803,971

(22) Filed: Mar. 13, 2001

(65) Prior Publication Data

US 2001/0026708 A1 Oct. 4, 2001

(30) Foreign Application Priority Data

| | | |
|---|---|---|
| Mar. 14, 2000 | (JP) | 2000-076371 |
| Dec. 28, 2000 | (JP) | 2000-400116 |
| Mar. 8, 2001 | (JP) | 2001-065040 |

(51) Int. Cl.[7] ..... G03G 15/00
(52) U.S. Cl. ..... 399/159; 399/252
(58) Field of Search ..... 399/111, 116, 399/159, 161, 252, 265, 279, 286; 430/56, 57, 58, 110, 114, 124, 127

(56) References Cited

U.S. PATENT DOCUMENTS

| | | | | |
|---|---|---|---|---|
| 4,924,267 A | | 5/1990 | Yoshikawa et al. | 399/112 |
| 5,471,284 A | | 11/1995 | Fujii et al. | 399/12 |
| 5,768,660 A | | 6/1998 | Kurihara et al. | 399/111 |
| 5,835,818 A | | 11/1998 | Hoshika et al. | 399/26 |
| 5,891,600 A | * | 4/1999 | Okuno et al. | 430/110 |
| 5,923,918 A | | 7/1999 | Nakagawa et al. | 399/27 |
| 5,943,541 A | * | 8/1999 | Amamiya et al. | 399/116 X |
| 5,978,635 A | * | 11/1999 | Azuma et al. | 399/283 |
| 6,015,647 A | * | 1/2000 | Ugai et al. | 430/110 |
| 6,041,196 A | | 3/2000 | Nakagawa et al. | 399/27 |
| 6,101,354 A | | 8/2000 | Nakagawa et al. | 399/225 |
| 6,118,960 A | | 9/2000 | Nakagawa et al. | 399/111 |
| 6,137,966 A | | 10/2000 | Uehara et al. | 399/13 |
| 6,295,437 B1 | * | 9/2001 | Hodoshima et al. | 399/159 X |

FOREIGN PATENT DOCUMENTS

| | | | |
|---|---|---|---|
| JP | 36-10231 | | 7/1960 |
| JP | 59-53856 | | 3/1984 |
| JP | 410073933 | * | 3/1998 |

OTHER PUBLICATIONS

"Persistant Internal Polarization (Photoelectrets)," Berg, Focal Press Limited, Zurich Switerzland, pp. 94–116.

* cited by examiner

*Primary Examiner*—Hoan Tran
(74) *Attorney, Agent, or Firm*—Fitzpatrick, Cella, Harper & Scinto

(57) ABSTRACT

An image forming apparatus and a process cartridge have a wide optimum range of the toner charging amount and produce an excellent gradient and have an image bearing body and a developer carrying body. The electrostatic capacity of the image bearing body per cm2 is not less than 150 pF and not greater than 600 pF.

9 Claims, 10 Drawing Sheets

POTENTIAL DISTRIBUTION IN CASE WHERE DRUM CT FILM THICKNESSES ARE DIFFERENT

CHARGE DENSITY DISTRIBUTION IN CASE WHERE DRUM CT FILM THICKNESSES ARE DIFFERENT

IMAGE FORMING APPARATUS AND PROCESS CARTRIDGE DETACHABLY ATTACHABLE TO IMAGE FORMING APPARATUS COMPRISING AN IMAGE BEARING BODY, AND A DEVELOPER CARRYING BODY

BACKGROUND OF THE INVENTION

1. Field of the Invention

The present invention relates to an image forming apparatus such as an electrophotographic copying machine, and an electrophotographic printer and the like, and a process cartridge.

2. Related Background Art

Conventionally, as electrophotography, there has been proposed a method in which an electrical latent image is formed on a photosensitive body having a photo-conductive surface in many ways, the latent image is developed with toner as a visualized image or toner image, the toner image is transferred onto a transfer material such as paper on demand, and, then, the toner image is fixed to the transfer material by heat and pressure, thereby obtaining a copy.

Nowadays, since improvement in resolving power and sharpness of an image have been requested, formation of a thin toner layer and associated devices must be developed more and more, and various methods for achieving this have been proposed.

For example, recently, there has been proposed a developing method of a non-magnetic one-component DC contacting type in which a semi-conductive developing roller or a developing roller having a dielectric surface layer is used and development is effected by contacting such a developing roller with a surface of a photosensitive body.

FIG. 10 shows such a developing method of a non magnetic one-component DC contacting type. In this method, a photosensitive drum 21 and a developing roller 81 contact each other and are rotated in the directions shown by the arrows A, B, respectively. The photosensitive drum 21 is charged by a charging roller 2, and a latent image is formed on the photosensitive drum 21 by a laser beam from an exposing unit 5. The latent image is visualized by a developing apparatus 80. Thereafter, toner 84 on the photosensitive drum 21 that is developed is transferred onto a transfer material 9 by a transfer roller 6 and then the toner image is fixed to the transfer material by a fixing apparatus 7. On the other hand, residual toner 84 remaining on the photosensitive drum 21 that was not transferred is removed by a cleaning blade 3 and then is collected into a cleaning container 4.

In the developing apparatus 80, there is provided an elastic roller 82 disposed within a developing container 85 containing toner 84 as one-component developer and urged against the developing roller 81 at an upstream side of an elastic blade 83 in a rotational direction of the developing roller 81, and, by rotating tho elastic roller in a direction shown by the arrow D, the toner 84 is supplied onto the developing roller 81. The toner 84 supplied to the developing roller 81 is carried as the developing roller 81 is rotated, and then the toner is charged by friction in an abut area between the elastic blade 83 and the developing roller 81, thereby forming a thin layer. The thin toner layer 84 is shifted by the developing roller 81 and is supplied to the electrostatic latent image in a nip between the developing roller and the photosensitive drum 21. Thereafter, the toner 84 remaining on the photosensitive drum (which was not applied to development in the nip between the photosensitive drum 21 and the developing roller 81) is removed by the elastic roller 82, and at the same time, as mentioned above, new toner 84 is supplied onto the developing roller 81. Such operations are repeated.

However, the above-mentioned conventional developing method of a non-magnetic one-component DC contacting type has the following problem.

FIG. 11 shows an image gradient of 64 gradations in 600 dpi in the above-mentioned method. The conventional photosensitive drum 21 is an organic photosensitive body of a laminated type and includes a charge transport layer having a thickness of 25 ,um. As can be seen from FIG. 11, in this method in which the development is effected by using DC voltage, density can quickly rise, but, image density quickly enters a saturated condition, and, thus, even when the gradient is improved, an image having a substantially high gradient may not be obtained.

To avoid this, if the charging amount of toner is increased, although the image density can moderately be increased, in the conventional example shown in FIG. 11, an optimum range in which the saturation of density and the desired gradient become compatible is only −30 $\mu$C/g, which is vers narrow.

SUMMARY OF THE INVENTION

An object of the present invention is to provide an image forming apparatus and a process cartridge in which an optimum range of the toner charging amount is wide and an excellent gradient can be obtained.

DETAILED DESCRIPTION OF THE PREFERRED EMBODIMENTS

Figure 1:
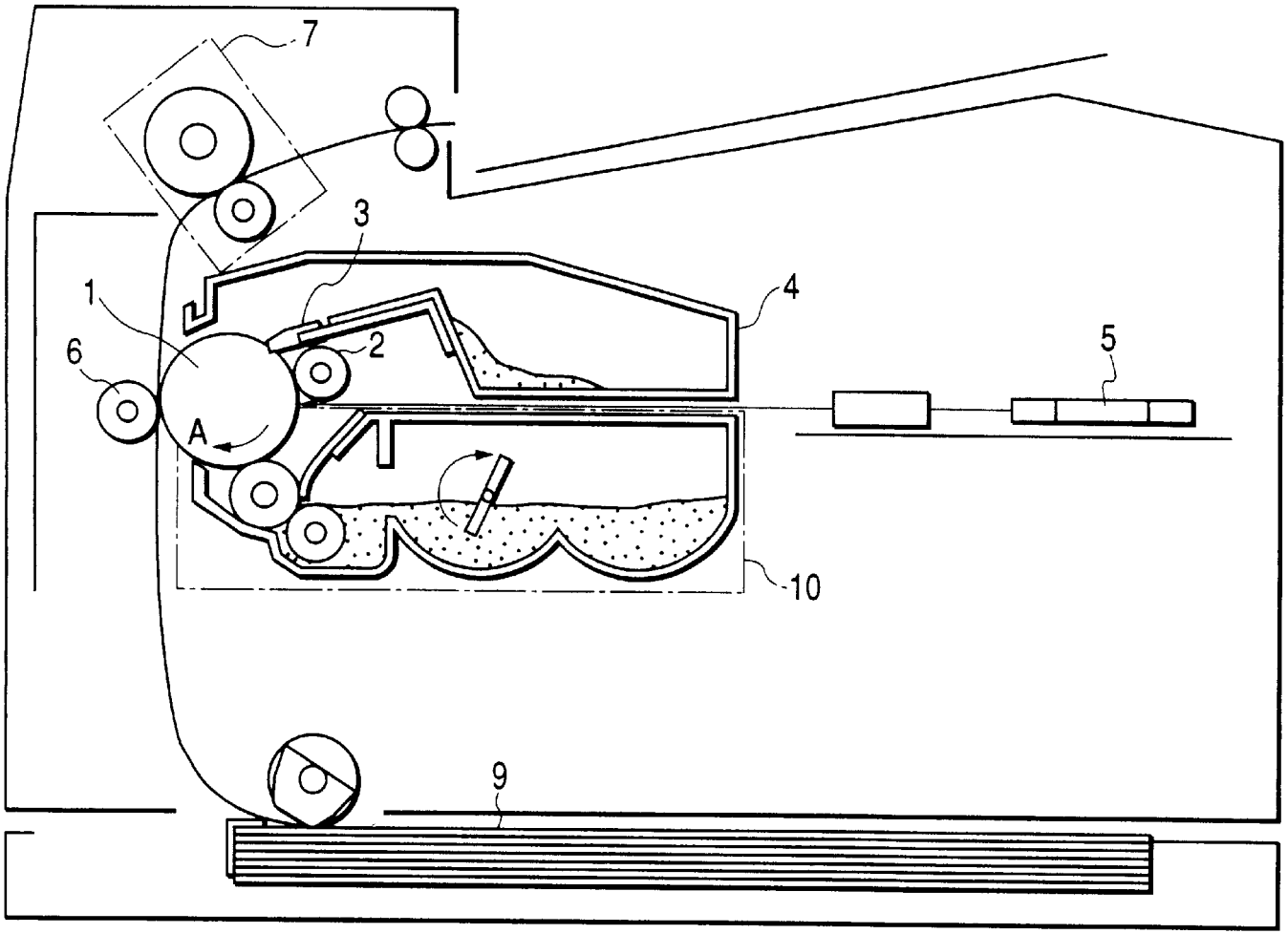
FIG. 1 is a schematic sectional view showing an image forming apparatus according to a first embodiment of the present invention.

In an image forming apparatus and a process cartridge according to the present invention, an image bearing body having an electrostatic capacity per $cm^2$ not less than 150 pF and not greater than 600 pF is used. When the electrostatic capacity of the image bearing body is included within the above range, an excellent gradient on the image bearing body (gradient in development of the electrostatic latent image with developer) can be obtained; whereas, if the capacity of the image bearing body is out of the above range, the gradient on the image bearing body is worsened, with the result that a good image having excellent gradient may not be formed.

The image bearing body used in the present invention is not particularly limited so long as it has the above-mentioned property, and, thus, a conventionally known image bearing body having a conductive substrate and a photosensitive layer formed on the conductive substrate can be used. Further, the electrostatic capacity of the image bearing body can be sought, for example, by forming the photosensitive layer on a metal substrate having an area of 1 $cm^2$ and by arranging a similar metal substrate having the same area on the photosensitive layer in parallel therewith and by measuring the electrostatic capacity between the photosensitive layer and the metal substrate on the photosensitive layer, for example, by using an LCR meter. By such measurement, an image bearing body having a preferred electrostatic capacity can be used in the present invention.

The material of the conductive substrate used in the image bearing body may be metal such as aluminium, copper, nickel or silver or alloy thereof, conductive metal oxide such as antimony oxide, indium oxide or tin oxide, carbon fiber, carbon black, or a mixture of graphite powder, and resin.

Further, a conductive layer may be provided on the substrate to cover a defect on the substrate and to protect the substrate. Such a conductive layer may be a coating on the substrate obtained by dispersing conductive substance (for example, metal powder such as aluminium, copper, nickel or silver; conductive metal oxide such as antimony oxide, indium oxide or tin oxide; high molecular conductive material such as polypyrrole, polyaniline or high molecular electrolyte; carbon fiber, carbon black, graphite powder; or conductive powder coated by such conductive substance) into binder resin (for example, thermoplastic resin such as acrylic resin, polyester resin, polyamide resin, polyvinyl acetate resin, polycarbonate resin or polyvinylbutylal resin; thermoset resin such as polyurethane resin, phenol resin or epoxy resin; or photo-curable resin) and by adding additive if necessary.

Further, if necessary, a barrier layer made of polyamide, polyurethane, epoxy resin or aluminium oxide may be interposed between the conductive substrate and the photosensitive layer.

The structure of the photosensitive layer can generally be divided into a single-layer type in which a charge generating substance and a charge transfer substance are included in the same layer and a laminated layer type that has a charge generating layer including a charge generating substance and a charge transfer layer including charge transfer substance. The present invention can utilize either one of the above types, but the laminated type is preferable.

The charge generating substance used in the charge generating layer may be azo pigment such as sudan red and dian blue; quinone pigment such as pyrene, quinone and anthoanthorone; quinocyanine pigment; perirene pigment; indigo pigment such as indigo and thioindigo and phthalocyanine pigment, or other organic pigment, or combination thereof.

Further, if necessary, binder resin is added. The binder resin may be a thermoplastic resin such as acrylic resin, polyester resin, polyamide resin, polyvinylacetate resin, polycarbonate resin or polyvinylbutylal resin; thermoset resin such as polyurethane resin, phenol resin or epoxy resin; or photo-curable resin.

In order to form the charge transfer layer, generally, coating liquid is formed by adding solvent to the charge transfer substance and binder resin, and such liquid is coated by coating means to form a photosensitive body. Material for the charge transfer layer may be compound of a hydrazone group, a compound of stilbene group, a compound of pyrazoline group, a compound of oxazole group, a compound of thiazole group or compound of triaryl amine group.

The solvent used in this case is selected from those having good dissolving ability to the binder resin and the charge transfer agent. Particularly preferred solvents are a ketone group such as methylethyl-ketone, acetone, methyl-isobutyl-ketone, cyclohexanone; an ether group such as diethyl ether, tetra hydrofuran; an ester group such as ethyl acetate and butyl acetate; a hydrocarbon group such as toluene and benzene; and a halogenated hydrocarbon group such as chlorobenzene and dichloromethane.

Binder material for the charge transfer layer may be for example, those dispersed into binder resin (for example, thermoplastic resin such as acrylic resin, polyester resin, polyamide resin, polyvinyl acetate resin, polycarbonate resin, polyvinylbutylal resin or polyvionyl-benzale resin; thermoset resin such as polyurethane resin, phenol resin or epoxy resin), as well as the polycarbonate resin in the present invention, and may be dispersed into an appropriate solvent. If necessary, an additive may be added.

A ratio of the charge transfer agent to the binder resin is generally 20% to 70% and preferably 30% to 65% depending upon the kinds of the binder resin and the charge transfer agent. If the ratio of the charge transfer agent is small, adequate sensitivity may not be obtained. On the other hand, if the ratio of the charge transfer agent is too great, the strength of the surface is reduced to cause easy damage.

Further, a lubricant such as inorganic filler, polyethylene, polyfluoroethylene or silica may be added as a surface layer, if necessary. The ratio of the lubricant to the binder resin is 0.1% to 50% and preferably 1 to 30 t. Further, if necessary, an additive such as a dispersion aiding agent, silicone oil, a leveling agent, metal soap or a silan coupling agent may be added.

Further, if necessary, an additive such as an electron attracting substance, an electron applying substance, an ultraviolet ray absorbing agent or an oxidation preventing agent may be added.

The coating method for various layers used in the present invention may be an immersion coating method, a spray coating method, a roll coater coating method or a gravure coater coating method.

The electrostatic capacity of the image bearing body can be adjusted in dependence upon the kind of material to be used and can be adjusted in accordance with the film thickness of the photosensitive layer of the image bearing body. In case of the image bearing body of the above-mentioned laminated type, in order to form the image bearing body having the above-mentioned electrostatic capacity, it is preferable that the film thickness of the charge transfer layer is selected to be 10 to 15 $\mu$m in order to adjust the electrostatic capacity of the image bearing body within the abovementioned range.

Further, in the present invention, it is preferable that a protection layer is provided to protect the surface of the image bearing body. By providing such a protection layer, the service life of the image bearing body can be extended, and a good image can be formed for a long term.

Material for forming the protection layer is not particularly limited so long as it provides moderate hardness and it does not influence the photo-sensitivity of the image bearing body, and may be, for example, polyester resin, polyacrylate resin, polyethylene resin, polystyrene resin, polybutadiene resin, polycarbonate resin, polyamide resin, polypropylene resin, polyimide resin, polyamide imide resin, poly sulfone resin, polyacryl-ether resin, polyacetal resin, phenol resin, acrylic resin, silicone resin, epoxy resin, urea resin, allylic resin, alkyd resin, butylal resin, phenoxy resin, phosphasen resin, acrylic modified epoxy resin, acrylic modified urethane resin or acrylic modified polyester resin.

The film thickness of the protection layer is preferably 0.2 to 10 $\mu$m. If the film thickness of the protection layer is smaller than the above range, the mechanical strength may be worsened, and, if the film thickness of the protection layer is greater than the above range, the photo-sensitivity may be worsened.

Further, a proper additive may be added to the protection layer so that the protection layer can achieve other objects other than the protection of the surface of the image bearing body. For example, for the purpose of improving its weather proof ability, an additive such as oxidation preventing agent may be added to the protection layer. Alternatively, for the purpose of resistance control, a conductive powder, such as conductive tin oxide, or conductive titanium oxide may be dispersed in the protection layer. A method for coating the protection layer used in the present invention may be an immersion coating method, a spray coating method, a roll coater coating method or a gravure coater coating method, similar to the above mentioned method for coating various layers.

In the present invention, charging means for charging the image bearing body is used, and the charging means is not particularly limited so long as it can charge the image bearing body, and thus, various charging means, which are well-known in the art, can be used. Such charging means may be, for example, a charging apparatus of a non-contact type, such as a corona charger or a charging apparatus of the contact type such as a roller charger, a brush charger or a magnetic brush charger.

In the present invention, exposing means for forming the electrostatic latent image on the charged image bearing body is used, and the exposing means is not particularly limited so long as it can illuminate a beam modulated in accordance with inputted image information onto the charged image bearing body, and thus, various exposing means, which are well-known in the art, can be used. Such exposing means may be, for example, an LED laser or a laser beam generating device.

In the present invention, developing means for developing the electrostatic latent image formed on the image bearing body with developer is used, and the developing means may be developing means capable of effecting contact development and includes a developer carrying body disposed in contact with the image bearing body. As such developing means, a well-known developing apparatus comprising a developer container containing developer, a developer carrying body, a developer layer thickness regulating member for regulating a thickness of a developer layer on the developer carrying body, and an agitating member for agitating the developer in the developing container can be used.

Further, the developer is frictionally charged by the regulation of the layer thickness effected by means of the developer layer thickness regulating member and the agitation of the developer effected by the agitating member. By setting these conditions properly, the developer can be charged uniformly and properly. It is preferable that the setting is determined on the basis of a relative relationship to a desired charging amount of developer, an image forming process speed, and the like.

The developer carrying body can apply a developing bias in the development and preferably has moderate conductivity (or resistance). The configuration of the developer carrying body is not particularly limited. But, the developer carrying body is preferably an elastic roller and preferably has resistance not greater than $10^7$ Ω.

Further, the developer carrying body preferably has moderate surface roughness for the purpose of uniformly charging the developer. The surface roughness may be appropriately selected on the basis of a particle diameter of the developer to be carried and a desired charging amount. Further, the moderate surface roughness can be obtained, for example, by a blast method well-known in the art.

The elastic roller preferably has moderate elasticity and a shape keeping ability in order to enhance its contacting ability with the image bearing body. Such an elastic roller preferably has an Asker C hardness of 40 to 60 degrees. The Asker C hardness of the elastic roller can be measured by using an ASKER C-type rubber hardness meter manufactured by Kobunshi Keiki Co., Ltd. on the basis of SRIS (Japanese Rubber Institute Standard).

Further, it is preferable that the elastic roller has a resistance not greater than $10^7$ Ω in order to achieve good development. If the resistance of the elastic roller exceeds $10^7$ Ω, the roller cannot act as an electrode for charging the image bearing body not to provide adequate charging ability.

The resistance value of the elastic roller can be measured in the following manner. An aluminium roller having a diameter of 30 mm is urged against the elastic roller with an abut load of 500 gF (4.9 N) along the entire longitudinal area, and the aluminium roller is rotated at 0.5 rps. Then, a DC voltage of 400 V is applied to the developing roller. A resistance of 10 kΩ is arranged in a grounding side and the voltage between both ends of the resistance is measured, and the electric current is calculated, thereby calculating the resistance of the developing roller.

Although the configuration of the developer carrying body is not particularly limited so long as it has a conductivity capable of applying the developing bias to the image bearing body in the contact developing system, the above-mentioned preferred developer carrying body is constituted by a roller member having a conductive core portion and a conductive elastic layer disposed around the core portion. The core portion may be a core metal formed from metal such as aluminium. Further, the conductive elastic layer may be formed from a sponge-like resin compound into which a metal powder or conductive fine particles of metal oxide are dispersed. The Asker C hardness of the developer carrying body can mainly be adjusted on the basis of the layer thickness of the elastic layer, as well as the kind of material forming the elastic layer. Further, the resistance of the developer carrying body can be adjusted on the basis of the kind, the particle diameter, the dispersing amount and the dispersing condition of the conductive fine particles.

In this example, it is preferable that the developer having shape coefficients SF-1 of 100 to 180 and SF-2 of 100 to 140 is used. The developer is not particularly limited so long as it has the abovementioned shape coefficients, but, non-magnetic one component developer capable of being used properly in the contact development is preferred. The developer satisfying the above-mentioned shape coefficients has advantages that it has an excellent transferring ability and that it has good lubricating ability to reduce wear of the image bearing body when the residual toner remaining on the image bearing body, which was not transferred, is removed by the cleaning means, such as a blade or a fur brush. If the shape coefficients of the developer exceed the above-mentioned range, the configuration of the developer departs from a sphere and the transferring ability is reduced, and, thus, a good image having an excellent gradient cannot be obtained in the final image in which the toner image was transferred and fixed.

The shape coefficient SF-1 of the developer indicates the degree of sphericity, and, as the coefficient is increased from 100, the shape of the developer is gradually changed from the sphere to a non-fixed form. The shape coefficient SF-2 indicates the unevenness degree, and, as the coefficient is increased from 100, the unevenness of the surface of the toner becomes gradually noticeable. The shape coefficients of the developer can be calculated on the basis of a projected area of the developer in the developer picture enlarged by an electronic microscope, the absolute maximum length of the projected image and the peripheral length of the projected image.

$$SF\text{-}1=\{(MXLNG)^2/\mathrm{AREA}\}\times 100\pi/4$$

$$SF\text{-}2=\{(PERI)^2/\mathrm{AREA}\}\times 100\pi/4$$

(where, AREA is the toner projected area, MXLNG is the absolute maximum length and PERI is the peripheral length)

More specifically, the shape coefficients are obtained by sampling 100 toner images at random by using FE-SEM (S-800) manufactured by Hitachi, Ltd. and by introducing data of such images into an image analyzing device (Luzex 3) manufactured by Nicolet Japan Corporation through an interface for analyzing and by calculating the results on the basis of the above equations.

The manufacturing method for manufacturing the developer used in the present invention is not particularly limited so long as the shape coefficient are included in the above ranges. Thus, as well as a toner manufacturing method utilizing a so-called grinding method, the toner may be directly produced by using a suspension polymerizing method as disclosed in Japanese Patent Application Laid-open Nos. 36-10231 and 59-53856, or the toner may be directly produced by using a dispersion polymerizing method utilizing aqueous organic solvent into which monomer can be dissolved but polymer cannot be dissolved, or the toner may be manufactured by an emulsification polymerizing method, such as a soap-free polymerizing method, in which the toner is produced by effecting direct polymerization under the presence of a water-soluble polarity polymerization starting agent.

As material of the developer used in the present invention, various materials known in the art such a binding resin, a coloring agent, a charge controlling agent, a wax, an inorganic fine powder of an inorganic oxide or a conductive fine powder of a metal oxide, and an external additive such as a lubricant of an organic resin compound can be used.

The developer used in the present invention preferably has an average particle diameter of 5 to 8 $\mu$m for correct image reproduction. If the average particle diameter of the developer is smaller than the above range, mold releasing ability and the fluidizing ability of the developer will be worsened, with the result that the transferring efficiency and charging ability may be reduced. If the average particle diameter of the developer is greater than the above range, reproduction of each dot tends to be worsened. Incidentally, the average particle diameter of the developer can be measured by well-known methods, and, for example, it can be measured by using a Coulter counter TA-II type or a Coulter multisizer (manufactured by Coulter Inc.).

More specifically, in the present invention, the Coulter multisizer (manufactured by Coulter Inc.) is used, and a PC9801 personal computer (manufactured by 5 NEC) and an interface (manufactured by Nikkaki Co., Ltd.) outputting number distribution and volume distribution are connected thereto, and an electrolyte is adjusted to a solution including NaCl of 1% by using primary sodium chloride. For example, as the electrolyte, ISOTON R-II (manufactured by Coulter Scientific Japan) can be used.

In the measurement, a surface-active agent (preferably, alkyl benzene sulfonate) of 0.1 to 5 mL is added to the electrolyte solution of 100 to 150 mL as a dispersing agent and a specimen of 2 to 20 mg to be measured is further added. The electrolyte solution into which the specimen is suspended is subjected to dispersion treatment by an ultrasonic dispersing device for about 1 to 3 minutes, and the volume and number of toner particles having a diameter greater than 2 $\mu$m are measured by the Coulter multisizer using an aperture of 100 $\mu$m and the volume distribution and the number distribution are calculated. From such data, the volume average particle diameter based on a volume reference and a number average particle diameter based on the number reference are sought from the volume distribution and the number distribution according to the present invention, respectively.

Further, it is preferable that the developer used in the present invention has a charging amount of −40 to −20 $\mu$C/g in order to obtain a good gradient on the image bearing body. If the charging amount of the developer is smaller than the above range, the amount of reversal toner will be increased, thereby generating fog. On the other hand, if the charging amount of the developer is greater than the above range, a mirror imaging force of toner on the developing roller will be increased, thereby worsening the developing ability. This is not preferred. The charging amount of the developer can be measured by well-known methods, and, for example, the charging amount of the developer can be measured by sucking the toner on the developing roller coated with toner by means of a suction device to which a Coulomb's meter is connected and by effecting calculation on the basis of the charging amounts and weight of the toners before and after suction.

In the image forming apparatus according to the present invention, other than the above-mentioned means, other means may be provided, if necessary. Such other means may be, for example, transfer means for transferring the toner image onto the transfer material such as paper, fixing means for fixing the toner image transferred to the transfer material onto the transfer material, cleaning means for removing the residual toner remaining on the image bearing body after the transferring or/and pre-exposing means for erasing the charged history on the image bearing body after the cleaning. As such means, well-known means can be used.

Further, in the present invention, there is provided a process cartridge in which at least the image bearing body and the developing means are integrally formed as a cartridge unit which can detachably be mounted to a main body of the image forming apparatus. The process cartridge may further include other means, such as the cleaning means, as well as the image bearing body and the developing means, if necessary. When such a process cartridge is used, a frame integrally incorporating the image bearing body therein and a holding member for temporarily holding the image bearing body at a predetermined position are used, and the main body of the image forming apparatus is provided with guide members, such as rails, for guiding the process cartridge to a process position.

Now, an embodiment of the image forming apparatus and the process cartridge according to the present invention will be explained with reference to the accompanying drawings.

FIG. 1 is a sectional view showing the image forming apparatus according to this embodiment. In FIG. 1, a photosensitive drum 1 as an image bearing body (having a diameter of 30 mm (ϕ30 mm)) is rotated at 1 rps in a direction shown by the arrow A. The photosensitive drum 1 is uniformly charged (to have a dark portion potential of −600 V) by a charging roller 2 as charging means to which a DC voltage of −1150 V is applied. An exposing unit 5 as exposing means writes an electrostatic latent image on the charged photosensitive drum 1.

The exposing unit 5 as the exposing means serves to form the electrostatic latent image on the photosensitive drum 1 by illuminating the photosensitive drum 1 with a laser beam ON/OFF-controlled in response to an image signal inputted to the image forming apparatus (or such as a test pattern formed in the main body of the apparatus). The laser power is adjusted to achieve −150 V in case of entire surface exposure by means of the laser beam.

The electrostatic latent image is developed by a developing apparatus 10 as developing means disposed in the vicinity of the photosensitive drum 1, thereby visualizing the latent image as a toner image. In the illustrated embodiment, the photosensitive drum 1 and the developing apparatus 10 are as assembled as a process cartridge which can detachably be attached to the image forming apparatus. Incidentally, in the illustrated embodiment, so-called reversal developing for forming the toner image on the exposed area is used.

The toner image visualized on the photosensitive drum 1 is transferred onto a paper 9 as a recording medium by a transfer roller 6, and residual toner remaining on the photosensitive drum 1, which was not transferred, is scraped by a cleaning blade 3 and then is collected into a waste toner container 4. On the other hand, the cleaned photosensitive drum 1 is subjected to the above-mentioned operations repeatedly.

On the other hand, the paper 9 to which the toner image was transferred is subjected to a fixing treatment by a fixing apparatus 7, and, thereafter, the paper is discharged out of the apparatus. In this way, the printing operation is finished.

Here, the developing apparatus 10 according to the present invention will be further described with reference to FIG. 2.

Figure 2:
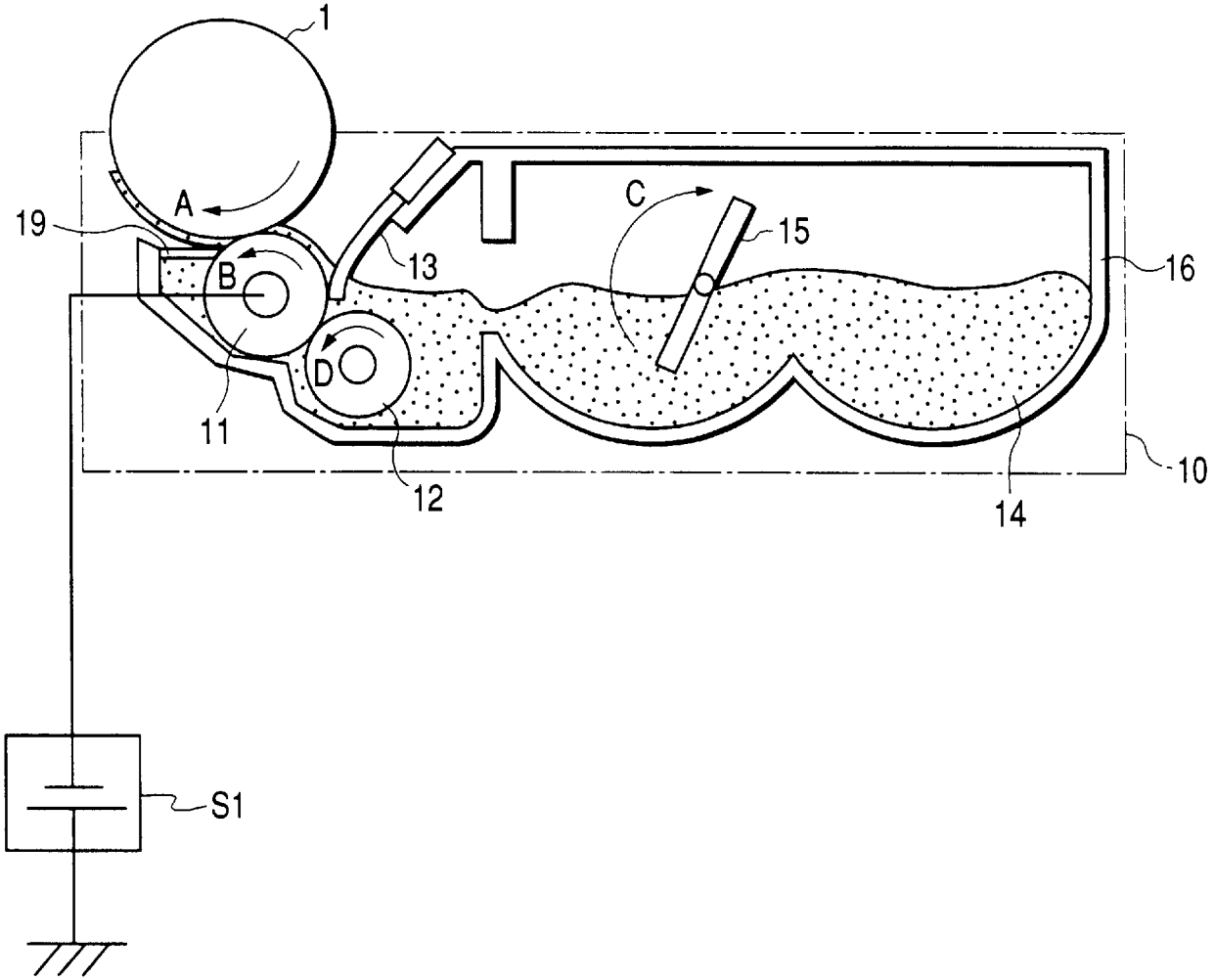
FIG. 2 is a schematic sectional view showing an example of a developing apparatus used in the image forming apparatus shown in FIG. 1.

In FIG. 2, the developing apparatus 10 includes a developing container 16 containing non-magnetic toner 14 as non-magnetic one-component developer, and a developing roller 11 as a developer carrying body having a diameter of 16 mm and opposed to the photosensitive drum 1 and disposed in an opening portion extending in a longitudinal direction of the developing container 16 and serves to develop and visualize the electrostatic latent image on the photosensitive drum 1. The developing roller 11 is urged against the photosensitive drum 1 with a predetermined abut width and is rotated in a direction shown by the arrow B. An elastic roller 12 and an elastic blade 13 are urged against the developing roller 11.

In the developing apparatus 10, the elastic roller 12 is rotatably supported and is urged against the developing roller at an upstream side of an abut area between the elastic blade 13 and the surface of the developing roller 11 in a rotational direction of the developing roller 11.

It is preferable that the elastic roller 12 is designed as a foam skeleton sponge structure or a fur brush structure having nylon or rayon fibers on a core metal in view of a toner 14 supplying ability and a toner stripping ability with respect to the developing roller 11. In the illustrated embodiment, an elastic roller 12 having a diameter of 16 mm and constituted by coating polyurethane foam on a metal core is used.

The abut width of 1 to 6 mm between the elastic roller 12 and the developing roller 11 is effective, and it is preferable that the relative speed between the elastic roller and the developing roller is generated in the abut area therebetween. In the illustrated embodiment, the abut width is selected to 4 mm, and the elastic roller 12 is rotatingly driven in a direction shown by the arrow D at a predetermined timing by driving means (not shown) to have a peripheral speed of 80 mm/s (in the developing operation).

At a downstream side of the elastic roller 12, the elastic blade 13 is supported by a blade support metal plate so that a distal end portion of the blade contacts (surface contact) the outer peripheral surface of the developing roller 11. The elastic blade 13 is constituted by a substrate formed from rubber material, such as urethane or from a thin metal plate made of SUS or bronze phosphide having spring elasticity, and rubber material adhered to the substrate and adapted to abut against the developing roller 11. In the illustrated embodiment, the elastic blade 13 is constituted by adhering plate-shaped urethane rubber having a thickness of 1.0 mm to a blade support metal plate.

Further, an abut direction is a so-called counter direction in which a distal end of the blade in the abut area is located at the upstream side in the rotational direction of the developing roller 11. Further, the abut pressure of the elastic blade 13 against the developing roller 11 is set to 25 to 35 g/cm. Incidentally, such line pressure is sought by inserting three thin metal plates having a known coefficient of friction and by effecting conversion on the basis of a value measured by a spring scale when the middle thin metal plate is drawn.

Further, in the developing roller 11, a right half thereof is inserted into the developing container 16 through the opening portion and the left half thereof is protruded and exposed out of the developing container 16. The exposed surface out of the developing container 16 contacts and opposes the photosensitive drum 1 located at the left of the developing apparatus 10.

The developing roller 11 is rotated in the direction B and the surface of the roller has moderate unevenness for increasing the sliding friction ratio with respect to the toner 14 and for carrying the toner 14 effectively. In the illustrated embodiment, the developing roller 11 constituted by coating an acryl urethane group on a silicone rubber layer having a diameter of 16 mm, a length of 240 mm and a thickness of 4 mm is used, and the roller resistance is set to $10^4$ to $10^5$ Ω, the surface roughness is set to 5 to 9 μm and the hardness is set to Asker C hardness of 45° (with load of 1 kg).

Further, the developing roller abuts against the photosensitive drum 1 with a penetrating amount of 70 μm and is rotated at a peripheral speed of 170 mm/s. Incidentally, the photosensitive drum 1 is rotated at a peripheral speed of 94.2 mm/s.

In the developing apparatus 10 as mentioned above, the toner 14 in the developing container 16 is carried toward the elastic roller 12 as the agitating member 15 is rotated in a direction shown by the arrow C.

Then, by the rotation of the elastic roller 12 in the direction shown by the arrow E, the toner 14 is carried to the vicinity of the developing roller 11. Then, in the abut area between the developing roller 11 and the elastic roller 12, the toner is charged triboelectrically by friction thereby to be adhered onto the developing roller 11.

Thereafter, as the developing roller 11 is rotated in the direction B, the toner is carried to pass through the abutting elastic blade 13, with the result that the thin toner layer is formed on the developing roller 11. In the illustrated embodiment, the various elements or members are set to obtain the good toner charging amount of −40 to −20 μC/g, a good toner coat amount of 0.4 to 1.0 mg/cm$^2$ and a good toner layer thickness of 10 to 20 μm.

The toner 14 is carried to the abut portion (developing portion) between the photosensitive drum 1 and the developing roller 11. In this developing portion, the thin toner layer formed on the developing roller 11 is transferred onto the electrostatic latent image on the photosensitive drum 1 by a DC voltage of −300 V applied to the developing roller 11 from a power supply S1, thereby forming the toner image corresponding to the electrostatic latent image.

The toner that was not used in development in the developing portion is collected at a lower part of the developing roller 11 as the developing roller 11 is rotated. Namely, such toner is stripped from the surface of the developing roller 11 at the abut area between the elastic roller 12 and the developing roller 11. A major part of the stripped toner is mixed with the toner 14 in the developing container 16 as the elastic roller 12 is rotated, thereby dispersing the charges on the toner into the toner 14. At the same time, by the rotation of the elastic roller 12, new toner is supplied onto the developing roller 11. Such a sequence is repeated.

According to the image forming apparatus of the illustrated embodiment, by setting the electrostatic capacity of the drum to 150 pF/cm$^2$ to 600 pF/cm$^2$, and preferably 172 pF/cm$^2$ to 600 pF/cm$^2$, excellent gradient on the drum can be obtained, and, by selecting the shape coefficient SF-1 to be 100 to 180 and the shape coefficient SF-2 to be 100 to 140, an excellent gradient on the drum can correctly be transferred onto the paper, thereby achieving an excellent gradient on the paper.

Further, in the illustrated embodiment, while an example that the process cartridge comprised of the photosensitive drum and the developing apparatus and detachably attachable to the main body of the image forming apparatus is used was explained, the process cartridge used in the present invention is not limited to such an example, but, for example, a process cartridge secured to the holding member and capable of replenishing only the toner may be used, or, a process cartridge integrally incorporating the developing apparatus, the photosensitive drum, the cleaning blade, the waste toner container and the charging apparatus in a cartridge unit, which is detachably attachable to the main body of the image forming apparatus, may be used. In place of the process cartridge, the developing apparatus may be secured to the main body of the image forming apparatus.

Further, in the illustrated embodiment, since the developing container having a plurality of compartments therein is used, the charging amounts of toners in the respective compartments are made substantially uniform. Accordingly, since the charging amount of toner 14 in the vicinity of the developing roller 11 becomes the charging amount suitable for the development, the toner 14 can quickly reach the preferred charging condition, with the result that a good image can be obtained immediately after the operation of the image forming apparatus is started.

EXAMPLE 1

In this example, the image forming apparatus shown in FIG. 1 was used. Further, in this example, as the image bearing body, a photosensitive drum having a photosensitive layer of the laminated type was used. Incidentally, in this example, the thickness of the charge transfer layer (CTL) was selected to be 15 μm.

On the other hand, the suspension polymerizing method in which the shape coefficients SF-1, SF-2 of toner can easily be controlled to be 100 to 180, 100 to 140, respectively and the particle distribution is sharp and a fine particle toner having particle diameter of 4 to 8 μm can be obtained relatively easily was used under a normal pressure condition or a pressurized condition, and colored suspension particles having a weight average particle diameter of 7 μm were manufactured by using styrene and n-butyl acrylate as the monomer, metal salicylate compound as the charge controlling agent, and saturated polyester as the polarity range and by adding the coloring agent.

By further adding hydrophobic silica of 1.5 wt % externally, negative polarity toner 14, which has excellent transferring ability as mentioned above and causes less wear of the photosensitive drum 1 in the cleaning, was manufactured. In this example, the obtained toner 14 was used as developer.

Various data relating to the present invention were obtained by using the above-mentioned construction.

Figure 3:
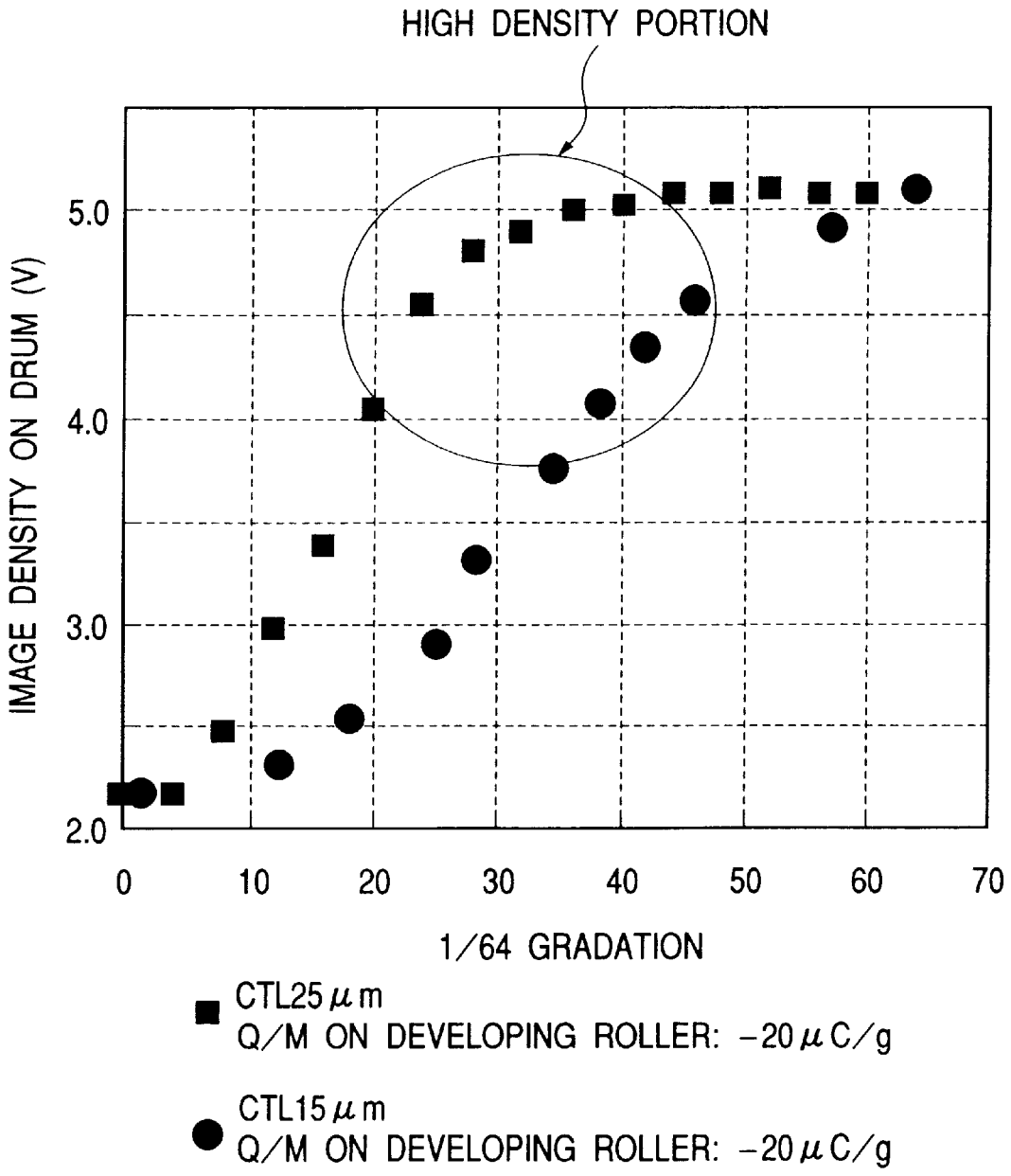
FIG. 3 is a view showing the relationship (CTL film thickness difference) between the image density on a drum and gradation in 64 gradations of 600 dpi in the first embodiment of the present invention.

First of all, the image density and the gradient on the drum were measured, regarding the photosensitive drum according to this example and the conventional photosensitive drum. In the conventional photosensitive drum, the film thickness of the charge transfer layer was 25 μm. Incidentally, in this example, the density measurement was effected by using a density sensor of the diffused reflection type. The results are shown in FIG. 3. As can be seen from FIG. 3, in this example, even when the charging amount (Q/M) on the developing roller is−20 μC/g, an excellent gradient was obtained. Particularly, improvement in destruction was greatly enhanced.

Figure 4:
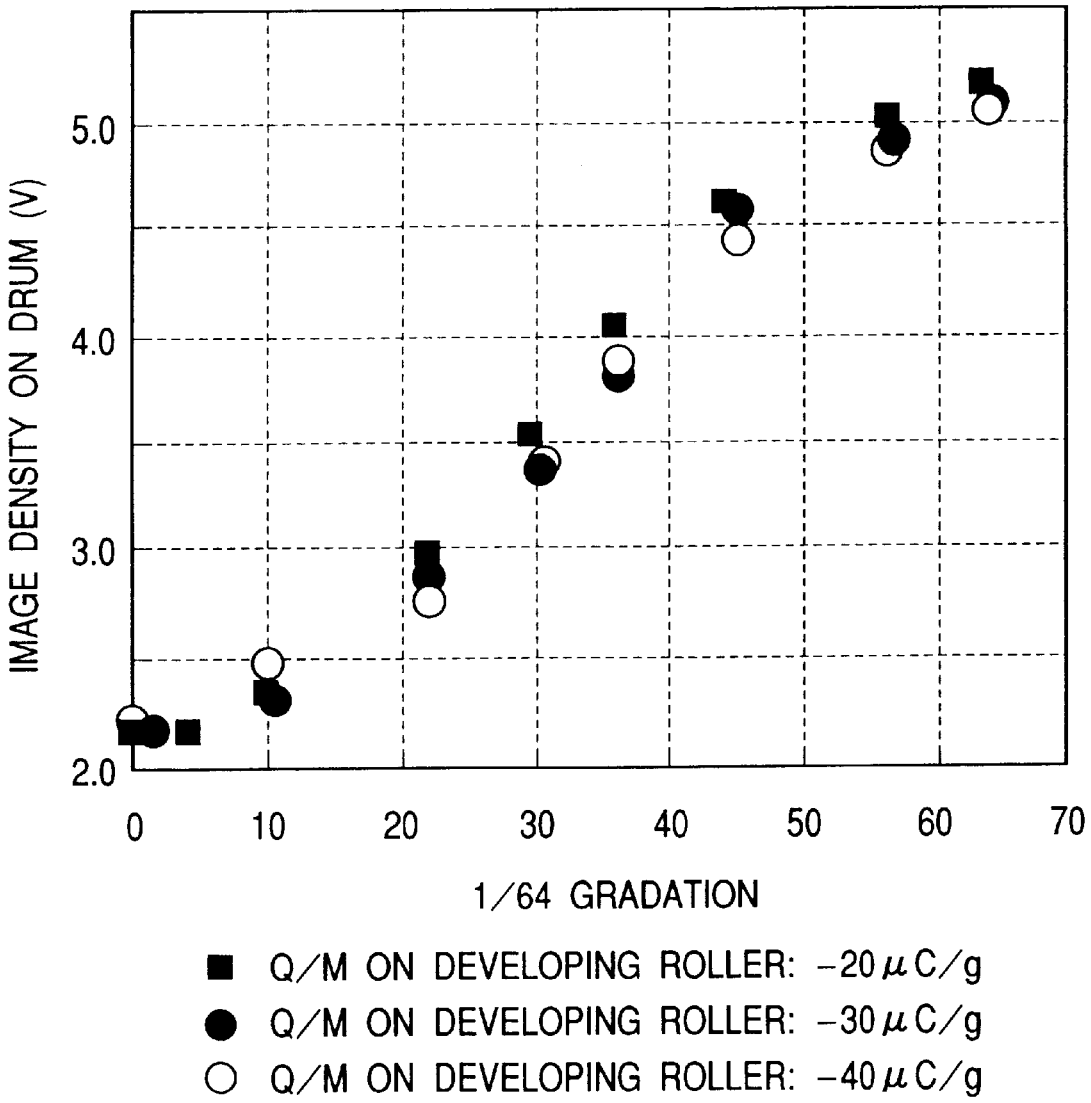
FIG. 4 is a view showing the relationship (toner charging amount difference) between the image density on a drum and the gradation in 64 gradations of 600 dpi in the first embodiment of the present invention.

Next, when the toner in which the toner charging amount (Q/M) on the developing roller was adjusted in the range of −40 to−20 μC/g was used in development in the image forming apparatus according to this example, the image density and gradient on the drum were measured. The results are shown in FIG. 4. From FIG. 4, when the charging amount (Q/M) on the developing roller is within the range of −40 to−20 μC/g, it was found that an excellent gradient can be obtained.

Figure 5:
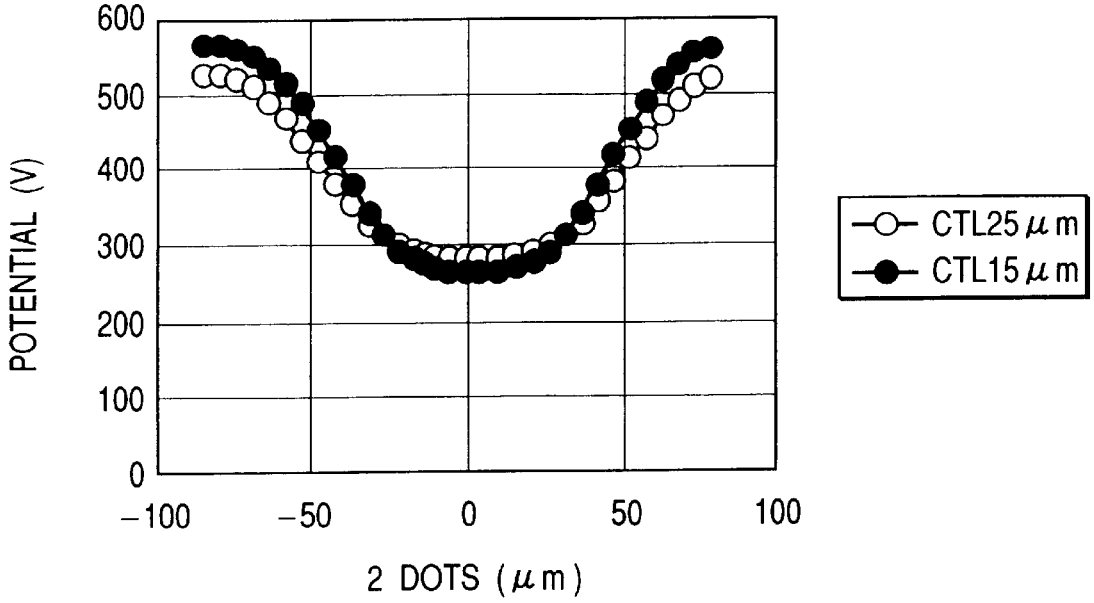
FIG. 5 is a view showing the potential distribution (CTL film thickness difference) in an isolated two-dot area of 600 dip in the first embodiment of the present invention.
Figure 6:
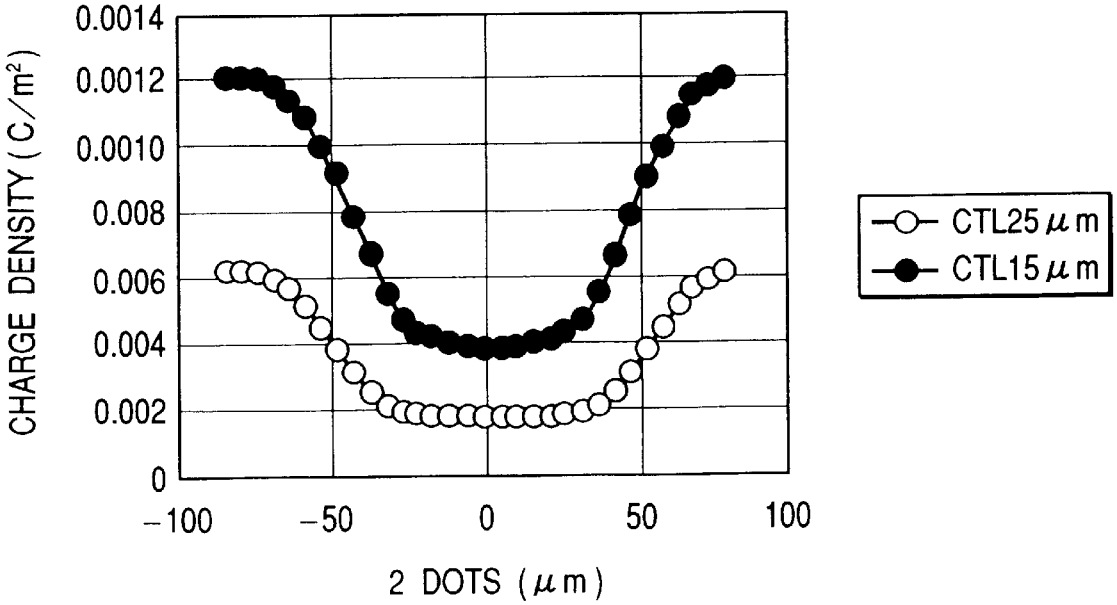
FIG. 6 is a view showing the charge density distribution (CTL film thickness difference) in an isolated two-dot area of 600 dpi in the first embodiment of the present invention.

This phenomenon depends upon the charge density of the electrostatic latent image. FIG. 5 shows the potential distributions in CTL 25 μm, CTL 15 μm, respectively, and FIG. 6 shows the simulation of charge density distributions in CTL 25 μm, CTL 15 μm, respectively. In this case, an isolated two-dot of 600 dpi is simulated under a dark portion potential of −600 V. Incidentally, in the simulation, the calculation of electrostatic latent image frequency described and used in the magazine "Electrophotography" written by R. M. Schaffert was used. Incidentally, more concretely, such calculation is described in chapter 3.2 "Mathematical handling of electrostatic image" (page 258) and in chapter 3.6 "Appendix A: Derivation of formula of electrical field for sine wave charge distribution on dielectric surface" (page 280) in the above magazine.

Although the potential distribution in CTL 25 μis similar to that in CTL 15 μm, when the charge density distribution in CTL 25 μm is compared with that in CTL 15 μm, it can be seen that the charge density distribution in CTL 15 μm is abruptly changed. In this way, in the photosensitive drum having a CTL of 15 μm, since the charge density is great and the difference in charge density caused by the electrostatic latent image is also great, the electrostatic latent image can be developed correctly even when the toner charging amount is great, as well as when the toner charging amount is small.

As mentioned above, by reducing the film thickness of the CTL of the photosensitive drum 1, i.e., by increasing the electrostatic capacity, even when the toner charging amount is changed, a good image having an excellent gradient can be obtained. In consideration of the compatibility between the electric current leak and the gradient, the optimum value of the electrostatic capacity is 150 to 600 pF/cm$^2$.

When it is assumed that the developer amount on the developing roller is m (mg/cm$^2$), the developer charging amount is Q (μC/mg), the shifting speed of the developing roller is V1, the shifting speed of the image bearing body is V2, the electrostatic potential (dark portion potential) is V3 and the electrostatic capacity of the image bearing body per 1 cm$^2$ is C, it is preferable that the following relationship is satisfied:

$$V3 \times C > Q \times m \times V1 / V2$$

By maintaining this relationship, the developing efficiency can be maintained to 100%, thereby stabilizing the solid black density (saturated maximum density).

Figure 7:
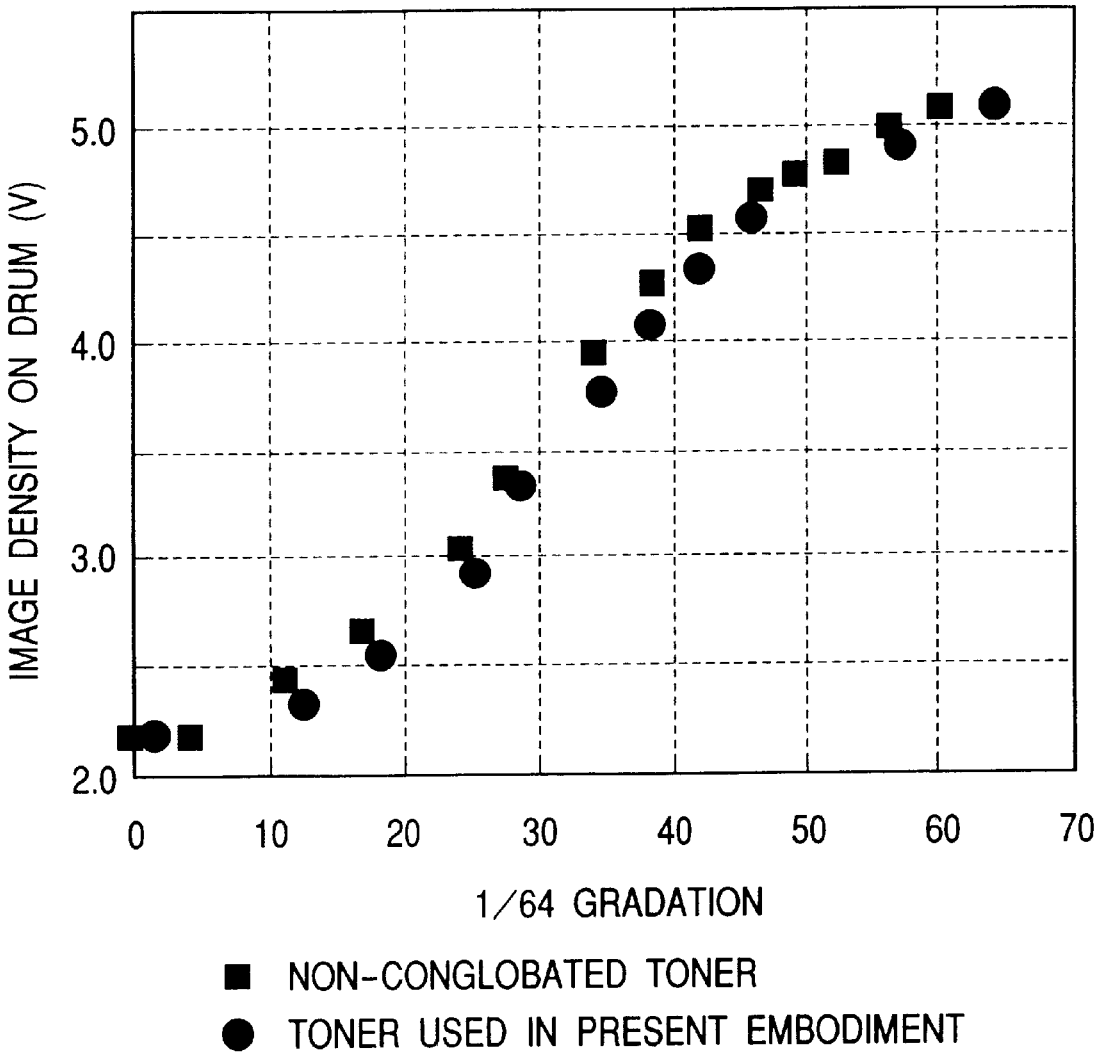
FIG. 7 is a view showing the relationship (toner conglobation difference) between the image density on a drum and the gradation in 64 gradations of 600 dpi in the first embodiment of the present invention.

FIG. 7 shows a result obtained by comparison between the toner of this example and non-conglobated toner, regarding image density and gradient on the drum. On the drum, there was no difference between the toner of this example and the non-conglobated toner.

Figure 8:
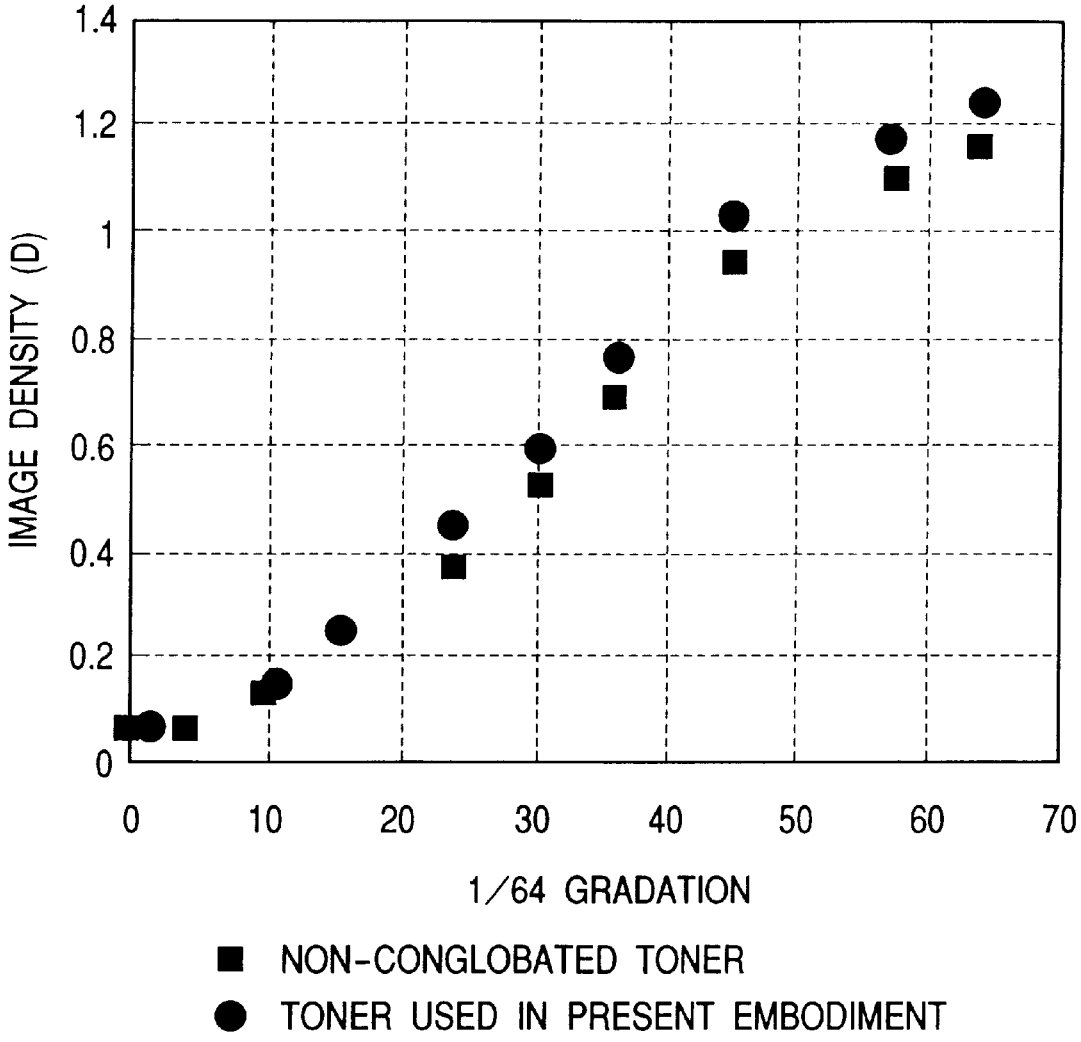
FIG. 8 is a view showing the relationship (toner conglobation difference) between the image density on paper and the gradation in 64 gradations of 600 dpi in the first embodiment of the present invention.

FIG. 8 shows a result obtained by comparison between the toner of this example and the non-conglobated toner, regarding the image density and the gradient on the paper. On the paper, it was found that the toner of this example having excellent transferring ability provides more excellent image density and gradient.

As mentioned above, by selecting the electrostatic capacity of the drum to be 150 to 600 pF/cm$^2$, an excellent gradient on the drum can be obtained, and by selecting the toner shape coefficients SF-1, SF-2 to be 100 to 180, 100 to 140, respectively, an excellent gradient on the drum can be transferred onto the paper correctly, with the result that the excellent gradient can be obtained on the paper.

EXAMPLE 2

Figure 9:
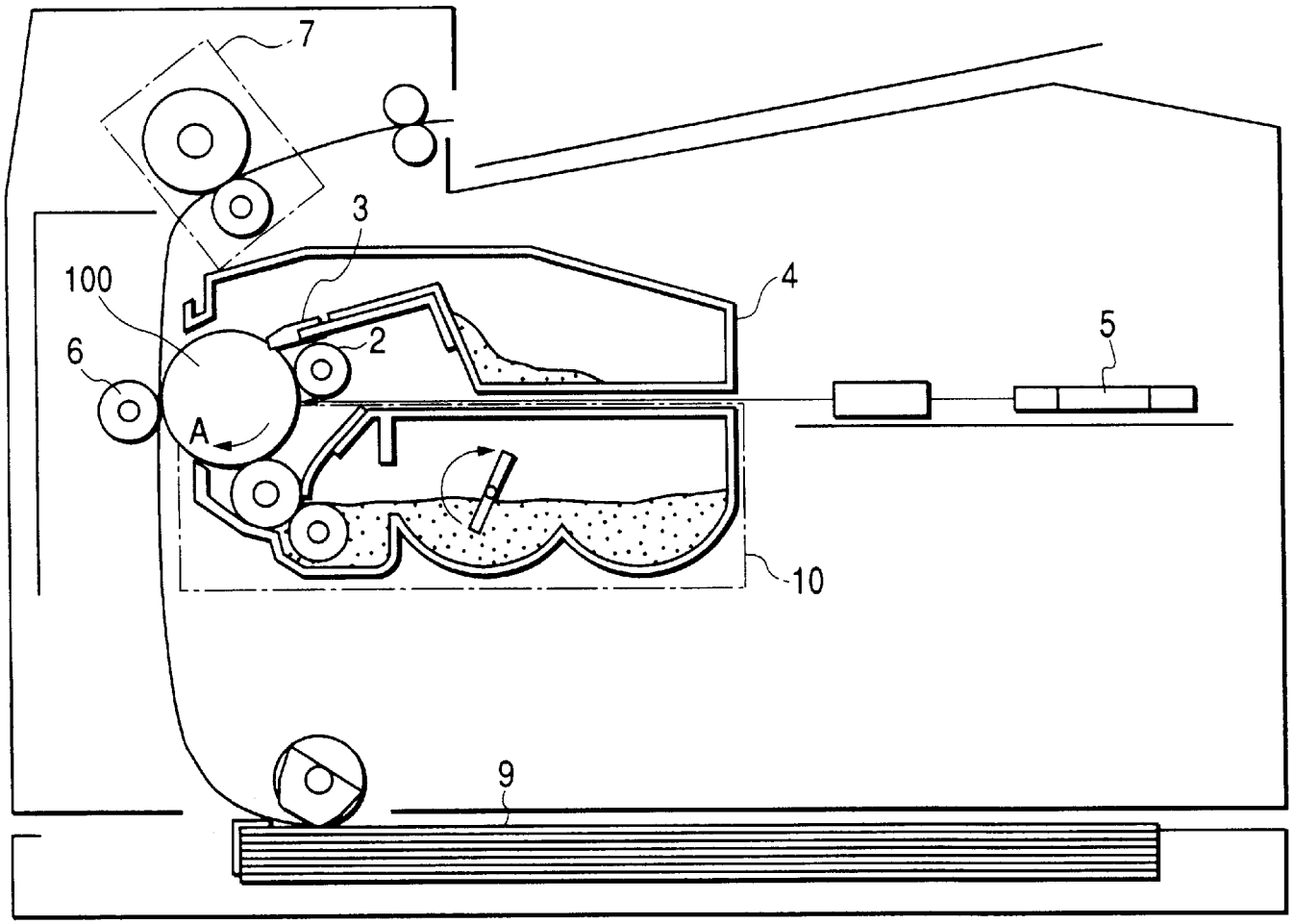
FIG. 9 is a schematic sectional view showing an image forming apparatus according to a second embodiment of the present invention.
Figure 10:
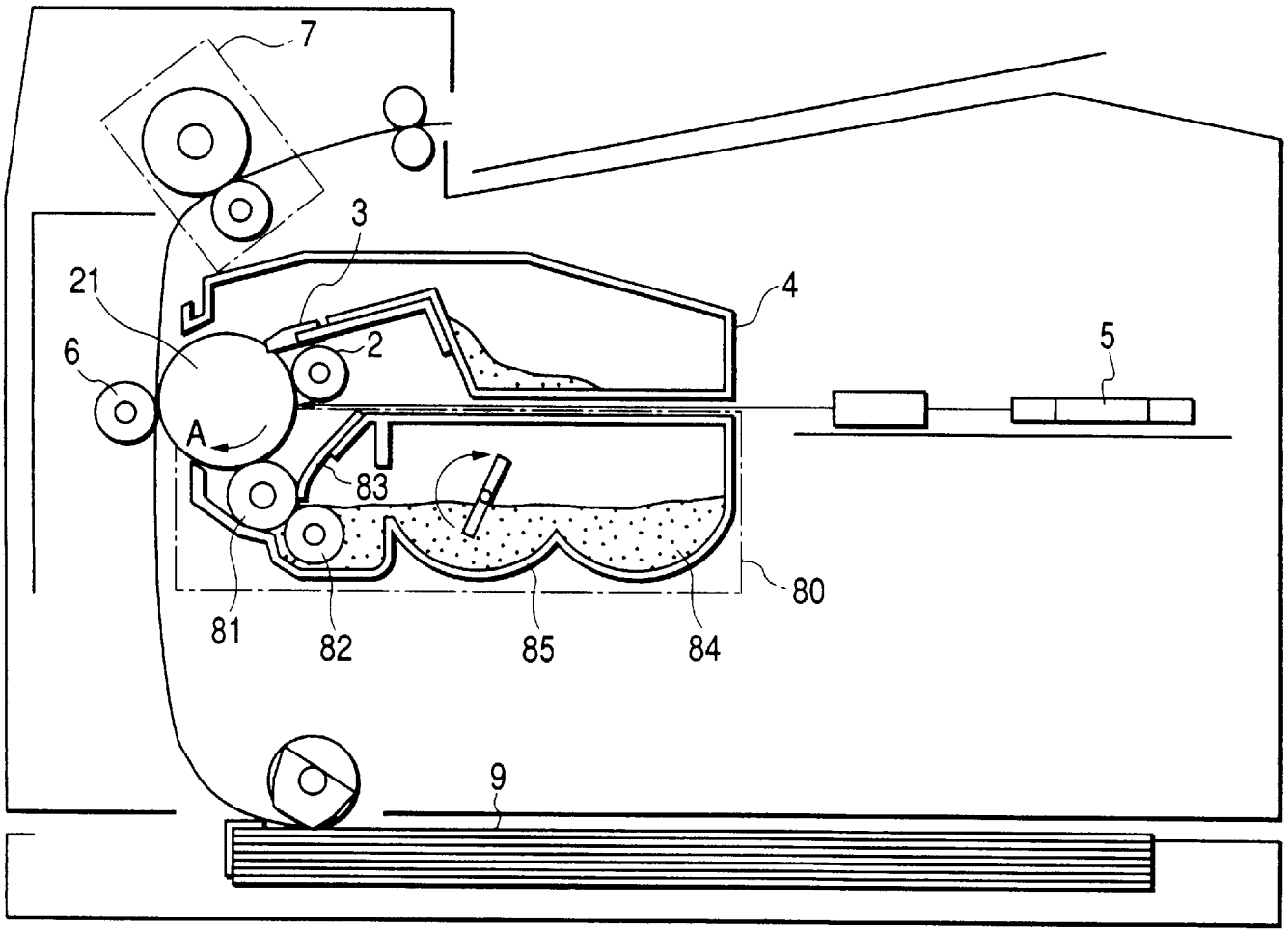
FIG. 10 is a schematic sectional view showing a conventional image forming apparatus.
Figure 11:
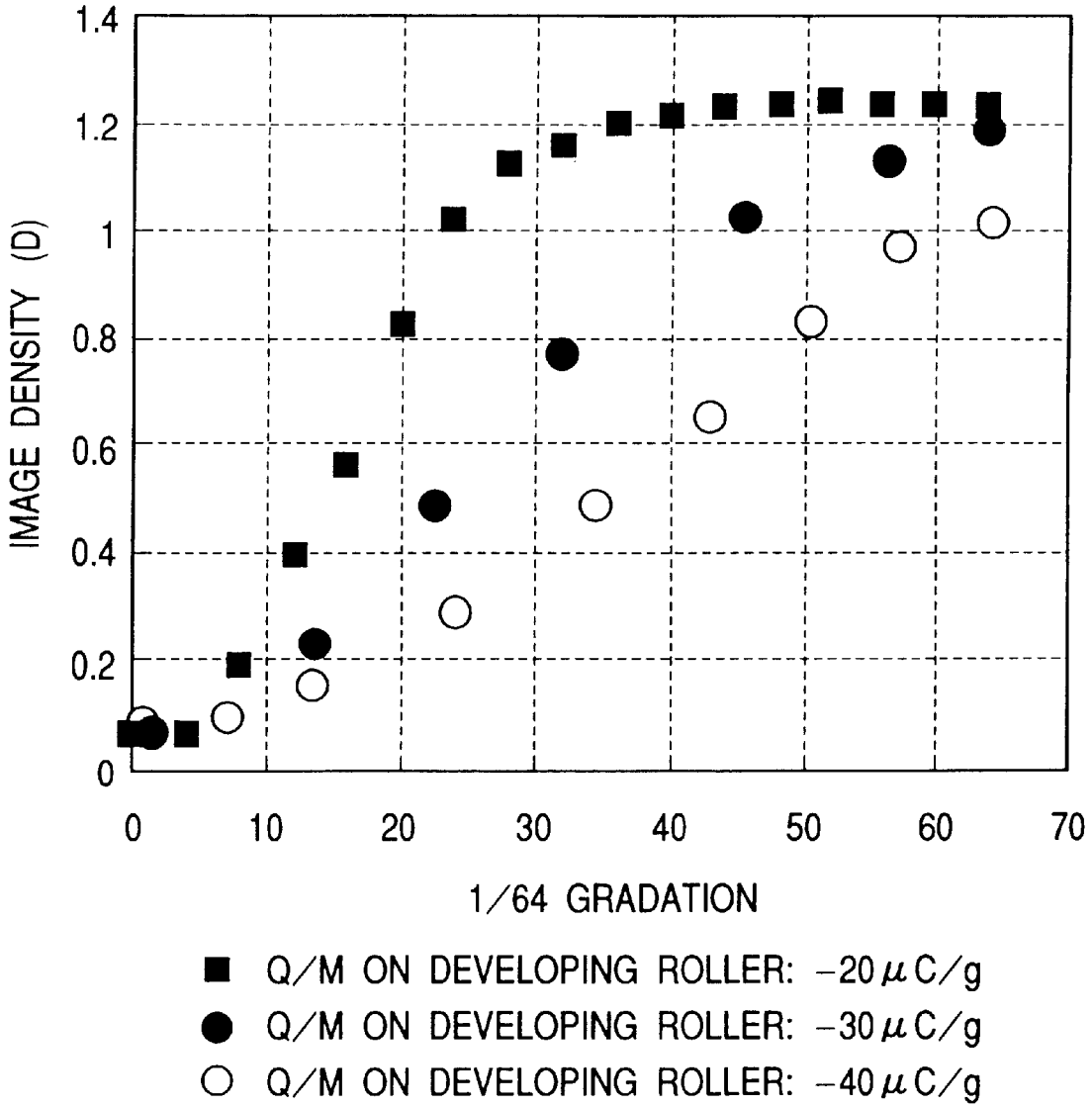
FIG. 11 is a view showing the relationship (toner charging amount difference) between the image density and the gradation in 64 gradations of 600 dpi in a conventional example.

In this example, the same construction as that in the example 1 was used, except that a photosensitive drum having a protection layer is used as the photosensitive drum 1. In this example 2, as shown in FIG. 9, a photosensitive drum 100 in which a protection layer is provided on a charge transfer layer is used.

By providing the above-mentioned protection layer, the wear of the photosensitive drum 100 is reduced, and image quality having stable and excellent gradient can be obtained for a long term.

As can be understood from the above explanation, the present invention has the developer carrying body contacting the image bearing body and adapted to carry the developer to the image bearing body, and, since the electrostatic capacity of the image bearing body is equal to or greater than 150 pF/cm$^2$ and equal to or smaller than 600 pF/cm$^2$, the gradient on the image bearing body is enhanced. Further, by selecting the toner shape coefficients SF-1, SF-2 to 100 to be 180, 100 to 140, respectively, an image quality having an excellent gradient on the transfer material can be obtained.

Further, when the image bearing body of the laminated type having the protection layer is used, regardless of the change in the charging amount of developer, an image quality having excellent gradient can be obtained for a long term.

Further, when the elastic roller is used as the developer carrying body, regardless of the change in the changing amount of developer, an image quality having an excellent gradient can be obtained for a long term.

Further, when the resistance of the elastic roller is equal to or smaller than $10^7$ Ω there is no influence of the resistance of the elastic roller, and, regardless of the change in the charging amount of developer, an image quality having an excellent gradient can be obtained for a long term.

Further, when the developer is a non-magnetic one-component developer, regardless of the change in the charging amount of developer, it is more effective to obtain image quality having excellent gradient.

Further, when the charging amount of the developer is −40 to −20 μC/g, regardless of the change in the charging amount of developer, it is more effective to obtain an image quality having excellent gradient.

Further, by using the process cartridge detachably attachable to the main body of the image forming apparatus and including at least the image bearing body and the developing apparatus, in addition to the effect of the image forming apparatus, a "user-friendly" construction having excellent handling ability can be obtained.

What is claimed is:

1. An image forming apparatus comprising:

an image bearing body; and a developer carrying body contacting said image bearing body and adapted to develop an electrostatic image formed on said image bearing body with developer; and transfer means for transferring a developer image on said image bearing body onto a transfer material;

wherein shape coefficients SF-1, SF-2 of the developer are 100 to 180 and 100 to 140, respectively, and wherein the electrostatic capacity of said image bearing body per cm$^2$ is not less than 150 pF and not greater than 600 pF.

2. An image forming apparatus according to claim 1, further comprising electrostatic image forming means for forming the electrostatic image on said image bearing body.

3. An image forming apparatus according to claim 2, wherein said image bearing body is a photosensitive body, and said electrostatic image forming means includes charging means for charging said image bearing body, and exposing means for exposing said image bearing body charged by said charging means in response to image information.

4. An image forming apparatus according to claim 1, wherein said developer carrying body is an elastic roller.

5. An image forming apparatus according to claim 1, wherein resistance of said developer carrying body is equal to or smaller than $10^7$ Ω.

6. An image forming apparatus according to claim 1, wherein the developer is non-magnetic one-component developer.

7. An image forming apparatus according to claim 1, wherein a charging amount of the developer is −40 μC/g to −20 μC/g.

8. An image forming apparatus comprising:

an image bearing body; and a developer carrying body contacting said image bearing body and adapted to develop an electrostatic image formed on said image bearing body with developer;

wherein an electrostatic capacity of said image bearing body per $cm^2$ is not less than 150 pF and not greater than 600 pF, wherein it is assumed that the amount of the developer on said developer carrying body is m ($mg/cm^2$), the amount of charge of the developer is Q (μC/mg), the moving speed of said developer carrying body is V1 (mm/sec), the moving speed of said image bearing body is V2 (mm/sec), the potential of an imaged portion to which the developer is to be adhered is V3 (V) and the electrical capacity of said image bearing body per $cm^2$ is C (pF), a following relationship is satisfied:

$$V3 \times C \geqq Q \times m \times V1/V2.$$

9. A process cartridge detachably attachable to a main body of an image forming apparatus, comprising:

an image bearing body; and a developer carrying body contacting said image bearing body and adapted to develop an electrostatic image formed on said image bearing body with developer;

wherein a developer image on said image bearing body is capable of being transferred onto a transfer material;

wherein shape coefficients SF-1, SF-2 of the developer are 100 to 180 and 100 to 140, respectively, and wherein an electrostatic capacity of said image bearing body per $cm^2$ is not less than 150 pF and not greater than 600 pF.

* * * * *

UNITED STATES PATENT AND TRADEMARK OFFICE

CERTIFICATE OF CORRECTION

PATENT NO. : 6,529,699 B2
DATED : March 4, 2003
INVENTOR(S) : Yasuyuki Ishii et al.

It is certified that error appears in the above-identified patent and that said Letters Patent is hereby corrected as shown below:

Column 1,
Line 36, "non" should be deleted.
Line 37, "magnetic" should read -- non-magnetic --.
Line 58, "tho" should read -- the --.

Column 2,
Line 14, "25 ,um." should read -- 25 μm. --.
Line 24, "vers" should read -- very --.
Line 52, "dip" should read -- dpi --.

Column 3,
Line 55, "polyvinylbutylal" should read -- polyvinylbutyral --.

Column 4,
Line 7, "antho-" should read -- anthro- --.
Line 8, "anthorone;" should read -- anthrone; --.
Line 14, "polyvinylbutylal" should read -- polyvinylbutyral --.
Line 38, "polyvionyl-benzale" should read -- polyvinyl-benzale --.

Column 5,
Line 24, "butylal" should read -- butyral --.

Column 6,
Line 32, "well-known" should read -- well known --.

Column 7,
Line 11, "abovementioned" should read -- above-mentioned --.
Line 42, "length)" should read -- length). --.

UNITED STATES PATENT AND TRADEMARK OFFICE

CERTIFICATE OF CORRECTION

PATENT NO. : 6,529,699 B2
DATED : March 4, 2003
INVENTOR(S) : Yasuyuki Ishii et al.

It is certified that error appears in the above-identified patent and that said Letters Patent is hereby corrected as shown below:

Column 12,
Line 50, “is-20” should read -- is -20 --.
Line 56, “to-20” should read -- to -20 --.
Line 61, “to-20” should read -- to -20 --.

Column 13,
Line 11, “25 μis” should read -- 25 μm --.

Signed and Sealed this

Thirteenth Day of January, 2004

JON W. DUDAS
*Acting Director of the United States Patent and Trademark Office*